United States Patent [19]

Sveen

[11] Patent Number: 4,669,917

[45] Date of Patent: Jun. 2, 1987

[54] FIXED MARINE STEEL STRUCTURE AND PROCEDURE FOR ASSEMBLY OF THE STRUCTURE

[75] Inventor: Dagfinn Sveen, Sandvika, Norway

[73] Assignee: Norsk Hydro a.s., Oslo, Norway

[21] Appl. No.: 793,287

[22] Filed: Oct. 31, 1985

[30] Foreign Application Priority Data

Dec. 4, 1984 [NO] Norway ..... 844824

[51] Int. Cl.[4] ..... E02B 17/00

[52] U.S. Cl. ..... 405/227; 405/204; 405/224

[58] Field of Search ..... 405/203, 204, 207, 205, 405/208, 224, 227; 114/264, 265

[56] References Cited

U.S. PATENT DOCUMENTS

| | | | |
|---|---|---|---|
| 3,852,969 | 12/1974 | Gibson et al. | 405/204 |
| 3,996,754 | 12/1976 | Lowery | 405/203 |
| 4,000,624 | 1/1977 | Chow | 405/204 |
| 4,557,629 | 10/1985 | Meek et al. | 405/195 |

FOREIGN PATENT DOCUMENTS

| | | | |
|---|---|---|---|
| 0099938 | 7/1982 | European Pat. Off. . | |
| 2924374 | 12/1980 | Fed. Rep. of Germany . | |
| 7512972 | 12/1975 | France . | |
| 2096673 | 10/1982 | United Kingdom | 405/204 |
| 2116615 | 9/1983 | United Kingdom . | |

*Primary Examiner*—Dennis L. Taylor

*Attorney, Agent, or Firm*—Wenderoth, Lind & Ponack

[57] ABSTRACT

A steel structure supports a deck with production facilities for oil and gas at large water depths and is assembled while it is floating in the sea. The structure includes a vertical erected triangular trusswork tower supported by a base and extending up to a level above the water surface where it supports a deck. The tower includes three corner columns interconnected by horizontal and diagonal trusswork stays. The tower is supported by three inclined supporting legs which terminate in base foundations. The supporting legs are symmetrically arranged around the tower in such a way that each of them faces a respective side plane of the triangular tower. Each supporting leg has a trusswork construction of triangular cross-section.

During installation of the structure the tower is floated vertically in the sea, while the supporting legs are floated in approximately horizontal position with installation frames mounted thereon. The upper part of each supporting leg is connected to a temporary joint of the tower, and the legs are rotated down into final position by wire systems pulling the installation frames to connection points of the frames to the tower.

6 Claims, 5 Drawing Figures

FIXED MARINE STEEL STRUCTURE AND PROCEDURE FOR ASSEMBLY OF THE STRUCTURE

BACKGROUND OF THE INVENTION

The present invention relates to a fixed steel structure for support of a deck having production facilities for oil and gas at large water depths. The invention also relates to a procedure for assembly of the structure while it is floating in the sea.

Fixed trusswork structures of steel for supporting decks with production installations are the most common platform type structures worldwide. The conventional structure contains from four to eight tubular legs which have upper ends above the water surface supporting a rectangular deck and which slope more or less outwards towards the sea bottom where they are fixed by piles. These legs also are interconnected by horizontal and diagonal stays so that the whole structure forms a three dimensional trusswork.

These are concepts which from a building and installation point of view work excellently at small and moderate water depths, i.e. to about 150–200 meters. This type of structure has been used for depths to 300 meters in the Gulf of Mexico.

For larger water depths this type of structure will have great dimensions and weight, and accordingly there will arise considerable drawbacks due to high capacity and production equipment demands at the fabrication yard. For most fabrication yards this will require expansion and new investment, which from a time and economical point of view will be unfavourable. Further, the dimension and weight of such a structure will result in the need for new transportation equipment in the form of larger barges, possibly other transportation methods, and the fabrication installation time will be expensive and the costs will be very high.

An already known proposal of a fixed steel platform for large water depths consists of a central vertical tubular column, the upper part of which below the water surface is connected to three inclined tubular supporting legs which are supported by foundations on the sea bottom. The center column carries a deck with production facilities at a given level above the water surface, and the column contains further risers and other necessary equipment. An arrangement of this type is described in Norwegian patent application No. 830.753; "Offshore construction and method for its arrangement". A substantial problem with platforms at larger depths results from normal oscillations and the appurtenant periods of oscillation of the platform. The highest periods of oscillation should generally be below a level where the excitation from the waves becomes substantial. If the periods of oscillation are too high, the dynamic response will be large and this will especially lead to fatigue problems in the steel material at critical parts of the structure. The periods of oscillation are directed by the stiffness of the structure and the oscillating mass. The stiffness is represented by the geometry of the structure and the quantity of steel in the elements contributing to the stiffness. The mass is represented by the weight of the structure including the deck and its equipment on the platform.

Another substantial contribution to the oscillating mass is the oscillating surrounding water. This oscillating mass of water is proportional to the volume of the structure and it is therefore desirable to reduce this volume to a minimum for those parts of the structure which have largest oscillating movement in the highest periods of oscillation.

The above mentioned proposal of a platform for large water depths is advantageous with regard to the transfer of waveforces and other environmental forces, but the choice of structural elements in the form of steel pipes with great diameter is disadvantageous since regards natural oscillation periods as the structure will have a large volume and the oscillating mass of water will be high. In order to obtain satisfactory periods of oscillation, the amount of steel consequently must be high, i.e. great wall thicknesses of the pipes.

Great wall thicknesses also are necessary with regard to stability and static strength due to the large water pressure acting on the pipes. The weight of the proposed structure for large water depths thus will be very high. Another disadvantage of such structure is the location of risers for gas/oil inside the center column, since the possibility of breaks/leaks therein will be a considerable security problem.

SUMMARY OF THE INVENTION

The main object of the present invention is to provide an optimal construction with regard to weight, stiffness and oscillating masses, and for adoption and transmission of static loads and wave and wind forces to the foundation on the sea bottom, so that there is obtained a low weight of the structure, and at the same time the requirement for the highest periods of oscillation to be below the critical level with regard to the excitation from waves is satisfied.

A further object is to provide that the structure, to the highest possible extent, can be produced at existing fabrication yards without the need for substantial expansion of capacity and new acquisition of equipment, and that the production time is short since the structure is formed from modules and thereby easily can be divided into several elements each of which has moderate dimensions and thus can be produced simultaneously at several production sites.

Another object of the invention is to provide a method for joining the various parts of the structure, wherein the joining of all of the components takes place while they are floating in the water.

The objects according to the invention are obtained by a structure including a vertical triangular trusswork tower which extends from a base secured to the sea bottom and to a level above the water surface where it carries a platform for production facilities, and three inclined triangular trusswork supporting legs symmetrically arranged around the tower. Each leg is secured at the upper end thereof to the tower and is secured at the lower end thereof to the sea bottom by piles or the like, so that the supporting points at the sea bottom constitute the corners of an equilateral triangle and that the foundation for the main vertical tower is situated in the center of such triangle. Three temporary trusswork frames during assembly and installation connect each of the legs to the lower part of the main vertical tower.

BRIEF DESCRIPTION OF THE DRAWINGS

Preferred embodiments of the invention are shown in the enclosed drawings wherein.

DETAILED DESCRIPTION OF THE INVENTION

Figure 1:
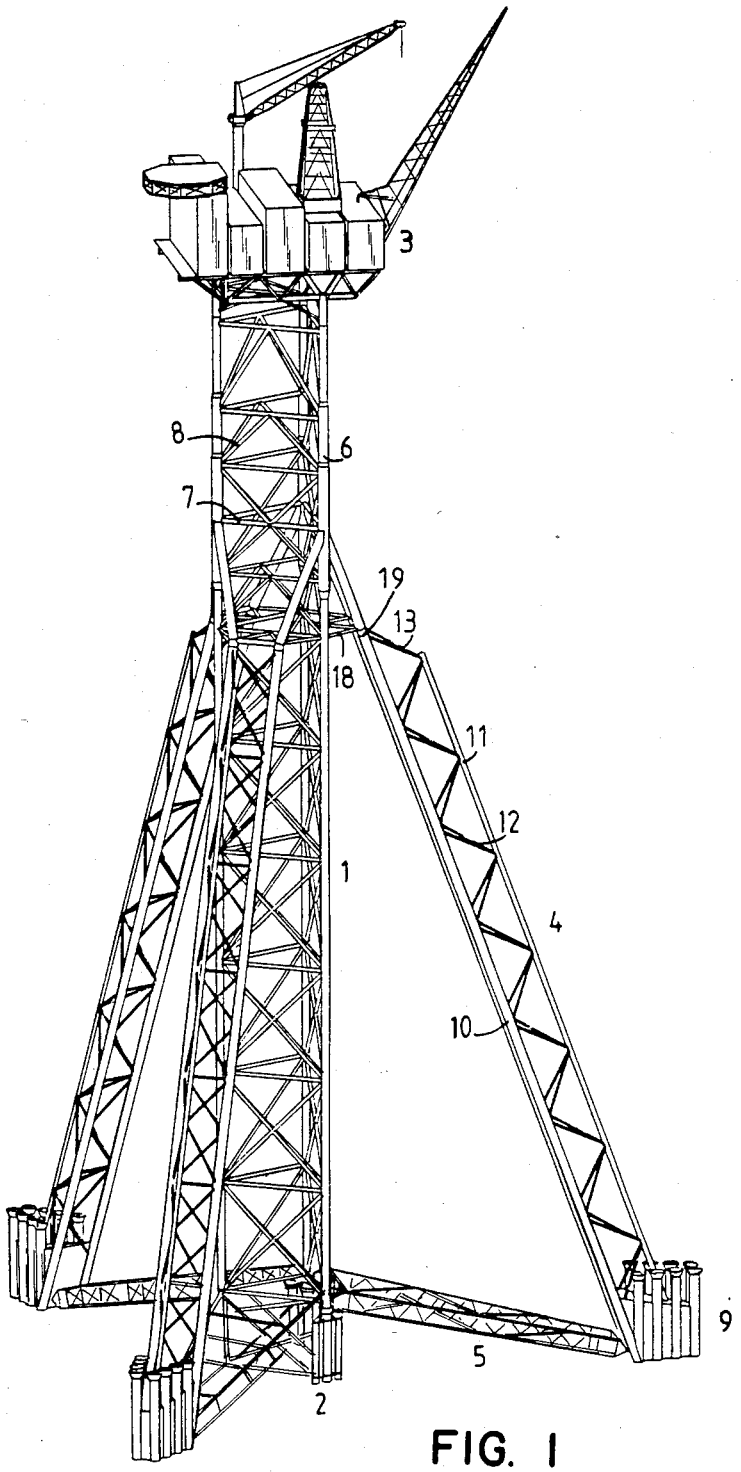
FIG. 1 is a perspective view showing the structure of the invention fixed to the sea bottom.

A vertical triangular trusswork tower 1 supports a deck 3 and includes three tubular corner elements or columns 6 which form the corners of an equilateral triangle and which are interconnected by horizontal 7 and diagonal 8 tubular trusswork stays. By means of this triangular design it is not necessary to provide the tower with an inner stay system which is common to known rectangular trusswork steel platforms. All that is required is an inner frame for support of the vertical risers for oil/gas.

This will accordingly give a slender and simple construction which is light, which gives low wave loads and which gives low oscillating water masses, and which thus contributes to low periods of oscillation.

Figure 5:
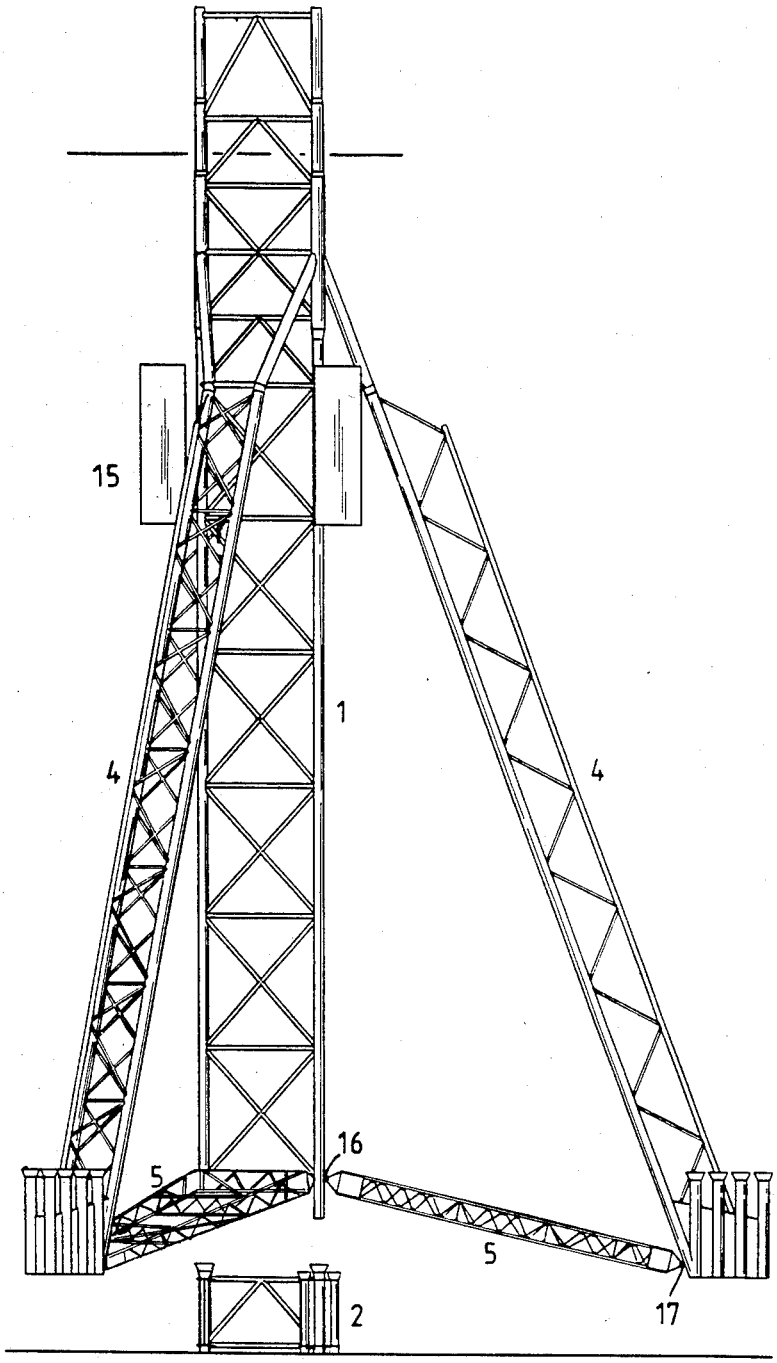
FIG. 5 is an elevation view showing the stage where all supporting legs are mounted immediately before the construction is lowered onto a tower base.

A base foundation 2 is a low triangular trusswork structure with dimensions corresponding to the tower so that the lower free ends of the corner columns 6 of the tower can be lowered into corresponding open columns in the piled base foundation during installation, and thus be supported thereby (FIG. 5).

Each of three supporting legs 4 includes two longitudinal tubular main elements 10 connected by trusswork elements, and the function of legs 4 is to support the upper part of the tower and thereby transfer static loads and loads from waves, wind and current down to piled base foundations 9 which support the legs. This direct transfer of forces from the upper part of the tower and down to the bottom, is an optimal structure as regards the attainment of high strength and stiffness combined with low weight of the structure. Further, each supporting leg includes a third longitudinal element 11 which together with the main elements 10 form a triangular trusswork by being mutually connected with stays 12. The primary function of this third longitudinal element 11 is by its dimension and distance from the main elements 10 to give the necessary stiffness to the supporting leg. The supporting leg 4 will thereby have the required stiffness to withstand collapse at the same time as there is obtained sufficient low natural periods of oscillation. The element 11 is terminated at its upper part by being connected to the main elements 10 by two diagonal stays 13.

Figure 2:
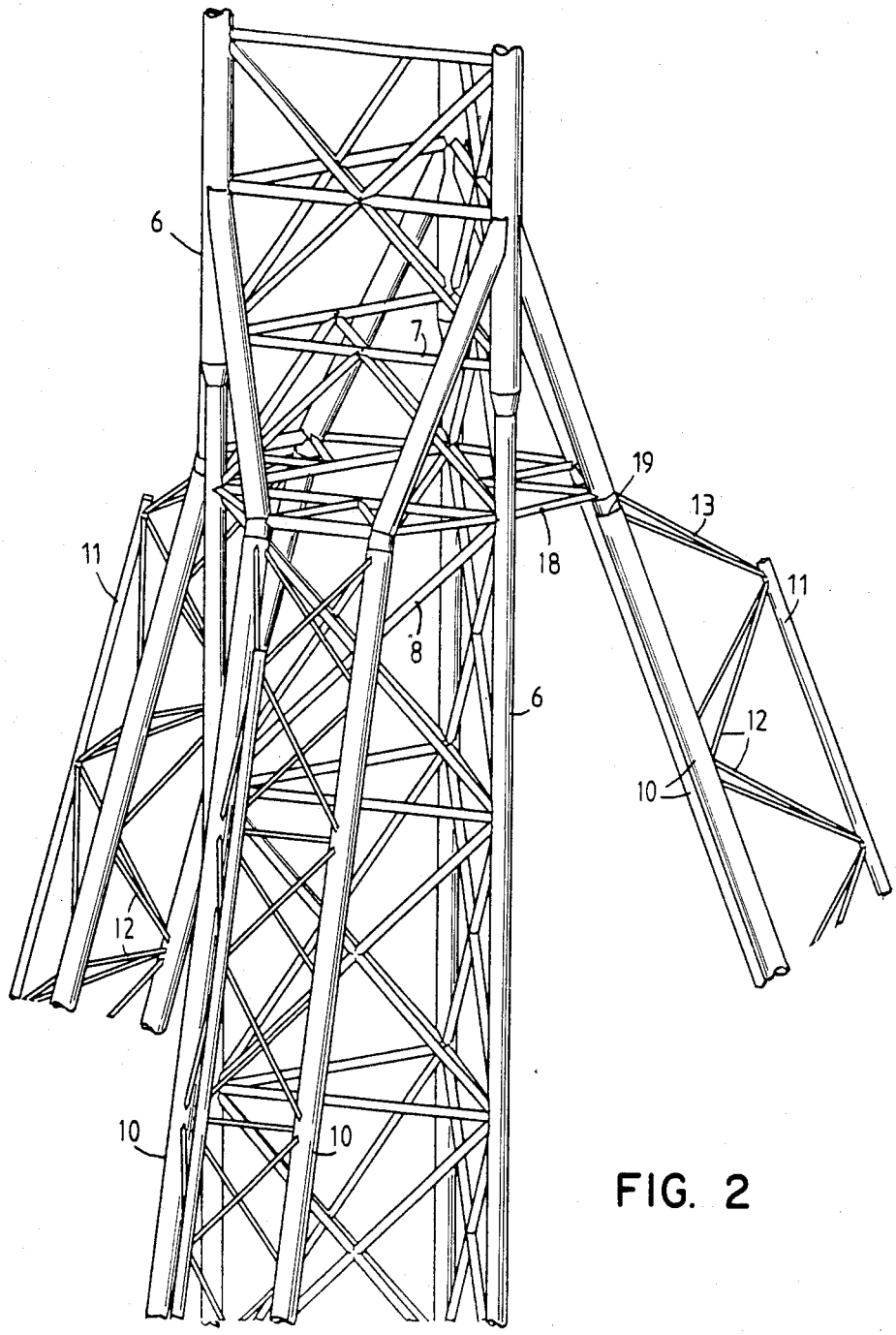
FIG. 2 is an enlarged perspective view of a part of the trusswork construction of the structure in the area where the tower thereof is connected to supporting legs thereof.

The supporting legs are symmetrically arranged around the tower with mutual spacings of 120° in such a way that a main plane formed by elements 10 of each leg faces a respective side plane of the triangular tower. The upper ends of the two main elements 10 of each supporting leg are bent somewhat outwards in the respective main plane and are connected to respective corner columns 6 (FIG. 2). The upper part of each element 11 is terminated at a level so that the two diagonal stays 13 thereof are connected to the respective main elements 10 at the level where they are bent outwards. This bending point also is supported by a system of horizontal stays 18 connected to the tower.

The design principles herein described make it possible in a simple way to produce the tower and the supporting legs as separate units and then to connect the elements together when they are floating in the sea, as the supporting legs 4 during production are separated from the tower 1 at a section 19 below the bent in the main elements 10. In this way, only the main elements 10 have to be joined by welding during assembly of the structure.

Figure 3:
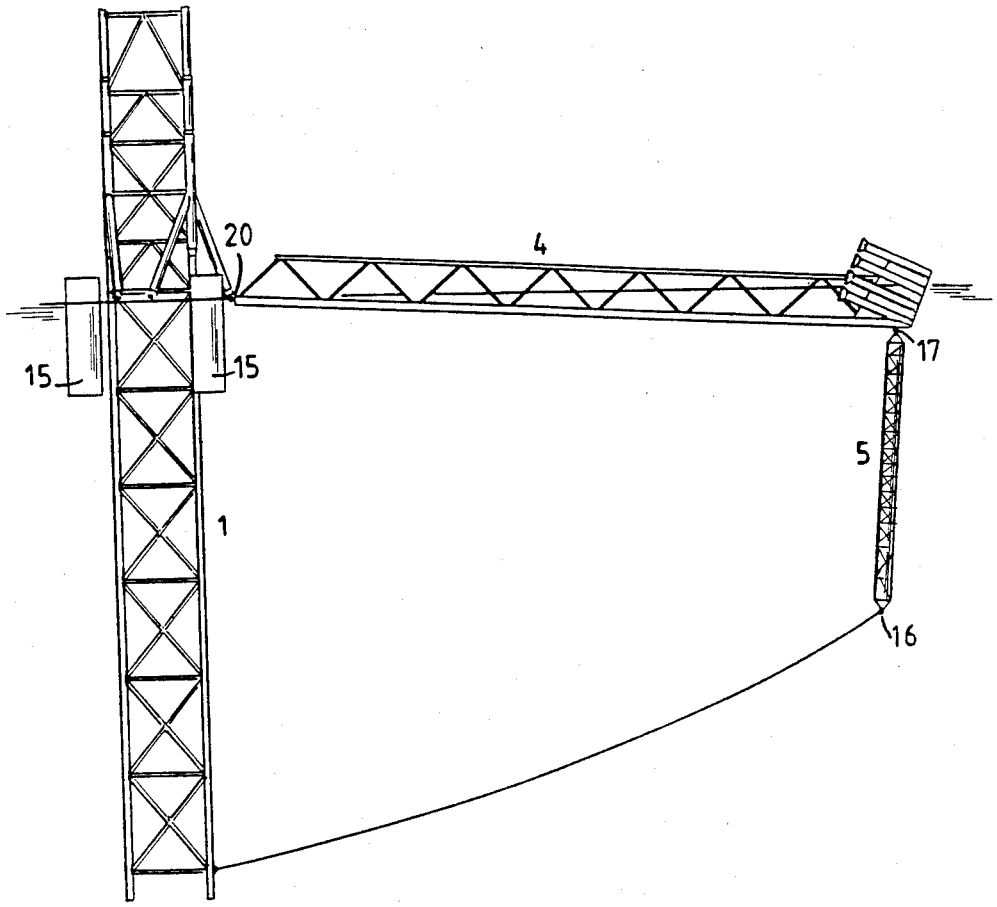
FIG. 3 is an elevation view showing the first stage in the assembly of a supporting leg and the tower.
Figure 4:
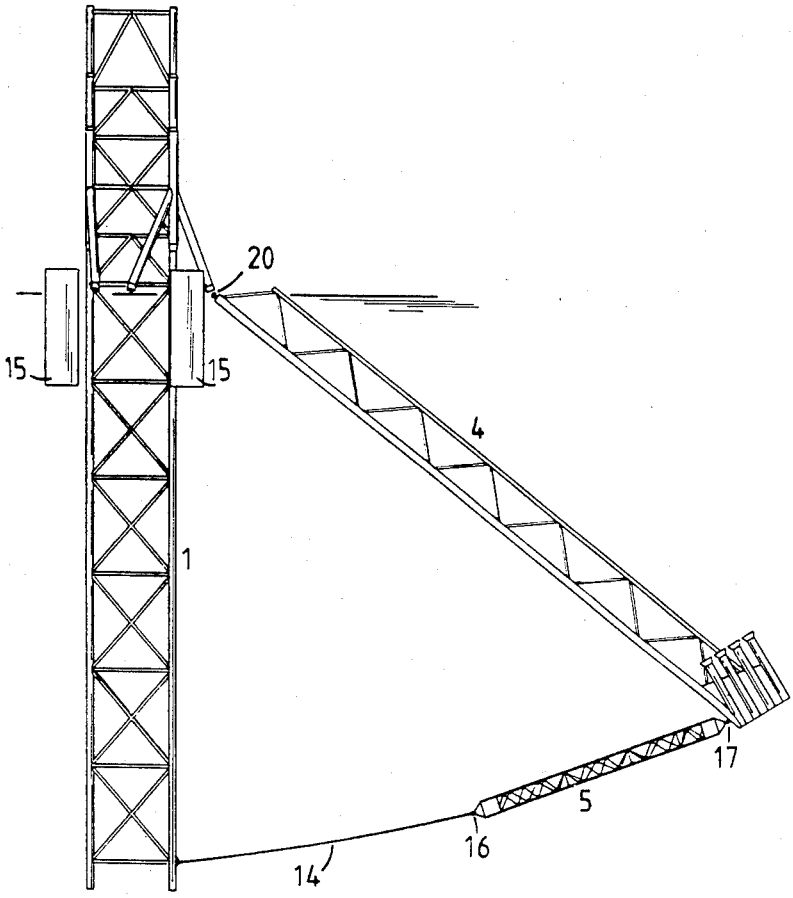
FIG. 4 is an elevation view showing a middle stage in the assembly of the supporting leg and the tower just as the leg is rotated to its final position.

For installation and assembly there are used three temporary frames 5, each of which has at an inner end thereof a bolt connection 16 for attachment to the lower part of the tower and enabling rotation with respect thereto about a horizontal axis parallel to the side plane of the tower. At the outer end of each frame 5 there is a corresponding bolt connection 17 for attachment to the lower part of the respective supporting leg 4, FIG. 3, FIG. 4 and FIG. 5.

The installation frames 5 are connected to the structure during assembly of the platform and can accordingly also be produced as separate units.

The invention relates accordingly to a procedure for fabrication and assembly of the structure by dividing it into several units consisting of the tower, a base foundation for the tower, three supporting legs with foundations and three installation frames. In addition there are buoyancy tanks 15 which are temporarly used for transportation of the tower, assembly of the structure, tow out and installation.

Each of the elements can be fabricated separated and by different yards if desired. The assembly and installation procedure according to the invention is described as follows:

The center tower 1 is transported to the assembly site either on a barge or a self-floating unit by means of buoyancy tanks mounted on the upper part of the tower.

The tower 1 is brought into a vertical position floating on the tanks 15 so that the connection point for the supporting legs to the tower will be above the water surface.

The three supporting legs 4 and the installation frames 5 are brought to the assembly site.

Each of the supporting legs is brought into a floating condition in the sea (FIG. 3) and the installation frame 5 is mounted in such a way that it will be vertically hanging below the base part of the leg 4. The supporting leg is mounted by its main elements 10 to a temporary revolvable bolt connection 20 at the point 19 where the leg in the fabrication phase is divided from the rest of the structure so that the leg can be rotated in a vertical plane around this connection 20. The lower part of the installation frame is then pulled towards the connection point of the tower by means of a wire or cable system 14 (FIG. 3 and 4) in such a way that the leg can be rotated into its final position and the bolts in the frame can be locked into an arrangement at a definite point on the tower. The upper part of the leg is adjusted to the appropriate position and welded to the tower. The process is repeated for the two other supporting legs.

When the platform is assembled, the structure is towed in a vertical position out to the field. Here the structure is installed by lowering it down in such a way that the three corner columns 6 are guided downwards into the corresponding open corner columns on the already installed base foundation 2, FIG. 5. Thereafter the foundations 9 of the supporting legs are firmly piled to the bottom.

I claim:

1. A fixed marine structure to be fixed to a sea bottom and supporting above the water surface a deck with production facilities for gas and oil, said structure comprising:

a tower foundation to be fixed to the sea bottom;

a tower supported by said tower foundation and extending upwardly therefrom, said tower having an upper end at a level to be above the water surface, said tower having a truss construction of equilateral triangular configuration including three substantially vertical columns at corners of said triangular configuration, adjacent pairs of said columns defining substantially vertical side planes of said tower;

a platform for supporting production facilities connected to said upper end of said tower;

three inclined supporting legs symmetrically arranged about said tower and connected thereto for supporting said tower;

each said leg having upper and lower ends and a truss construction of triangular configuration including two longitudinal main elements extending in an inclined common plane and a longitudinal third element spaced from said common plane, said two main elements having upper end portions bent outwardly from each other in said common plane and fixed to said columns of a respective said pair of columns such that said common plane intersects the respective said side plane, and said third element having an upper end free of connection to said tower and connected by respective stays to said main elements at the positions of bending of said upper end portions thereof; and said legs having at lower ends thereof means to be fixed to the sea bottom and defining an equilateral triangle with said tower foundation located centrally thereof.

2. A structure as claimed in claim 1, further comprising three installation frames of truss configuration for use in assembly and installation of said structure, each said frame having at a first end thereof means for connection to said lower end of a respective said leg such that said frame is pivotable with respect to said leg about a pivot axis parallel to said common plane of said leg, and each said frame having at a second end thereof means for connection to a lower end of said tower such that said frame is pivotable with respect to said tower about a pivot axis parallel to a respective said side plane of said tower.

3. A method for assembling and installing a fixed marine structure at a production location on a sea bottom for supporting above the water surface a deck with production facilities for gas and oil, said method comprising:

fixing a tower foundation at said production location on the sea bottom;

assembling at a fabrication location a tower having upper and lower ends and a truss construction of equilateral triangular configuration including three columns at corners of said triangular configuration, adjacent pairs of said columns defining side planes of said tower, said tower having at each said side plane a supporting leg connection position spaced from said upper end of said tower;

assembling at a fabrication location three supporting legs, each of which has upper and lower ends and a truss construction of triangular configuration including two longitudinal main elements extending in a common plane and a longitudinal third element spaced from said common plane, said two main elements having upper end portions bent outwardly from each other in said common plane, and said third element having an upper end connected by respective stays to said main elements at the positions of bending of said upper end portions thereof;

by means of buoyancy tanks floating said tower vertically in the water at an assembly location with said upper end of said tower extending upwardly and with said supporting leg connection positions above the water surface;

floating said three supporting legs substantially horizontally in the water with said upper end of each said leg directed toward a respective said side plane of said tower and with said lower ends of said legs directed away from said tower;

suspending from each said leg adjacent said lower end thereof a first end of a respective installation frame, such that said frames hang vertically downwardly in the water from respective said legs;

connecting said upper end of each said leg to a temporary connection at a respective said side plane adjacent the respective said connection position, such that said legs are pivotable in respective vertical planes about respective said temporary connections;

moving second ends of said frames toward said lower end of said tower, and thereby pivoting said legs about said temporary connections such that said legs are inclined downwardly away from said tower in desired supporting positions, and connecting said second ends of said frames to respective said side planes at said lower end of said tower;

permanently connecting said outwardly bent upper end portions of said two main elements of each said leg to said columns of a respective said pair of columns at the respective said supporting leg connection position, thereby forming a floating assembly;

towing said floating assembly from said assembly location to said production location and thereat lowering said assembly and connecting said lower end of said tower to said tower foundation; and fixing said lower ends of said legs to the sea bottom.

4. A method as claimed in claim 3, wherein said moving comprises pulling said second ends of said frames toward said tower by means of at least one cable system.

5. A method as claimed in claim 3, further comprising connecting a platform for supporting production facilities to said upper end of said tower and maintaining said platform free of connection to said legs.

6. A method as claimed in claim 3, further comprising removing said frames from said legs and said tower after connecting said tower to said tower foundation and after fixing said legs to the sea bottom.

* * * * *